US006320486B1

(12) United States Patent
Dietrich et al.

(10) Patent No.: US 6,320,486 B1
(45) Date of Patent: Nov. 20, 2001

(54) ELECTROMAGNETIC RELAY WITH A FUSE

(75) Inventors: Roman Dietrich; Peter Ritter, both of Berlin (DE)

(73) Assignee: Tyco Electronics Logistics AG, Steinach/SG (CH)

( * ) Notice: Subject to any disclaimer, the term of this patent is extended or adjusted under 35 U.S.C. 154(b) by 0 days.

(21) Appl. No.: 09/554,302

(22) PCT Filed: Oct. 21, 1998

(86) PCT No.: PCT/DE98/03090

§ 371 Date: May 11, 2000

§ 102(e) Date: May 11, 2000

(87) PCT Pub. No.: WO99/26265

PCT Pub. Date: May 27, 1999

(30) Foreign Application Priority Data

Nov. 14, 1997 (DE) ..... 297 20 249 U

(51) Int. Cl.[7] ..... H01H 51/22; H01H 7/16

(52) U.S. Cl. ..... 335/78; 335/83; 335/156

(58) Field of Search ..... 335/78–86, 141, 335/142, 156

(56) References Cited

U.S. PATENT DOCUMENTS 4,460,239 7/1984 Inoue ..... 439/786
5,132,653 * 7/1992 Nakatake et al. ..... 335/202

FOREIGN PATENT DOCUMENTS 32 09 915 A1 9/1983 (DE) .
37 08 723 A1 9/1988 (DE) .

* cited by examiner

*Primary Examiner*—Ray Barrera
(74) *Attorney, Agent, or Firm*—Schiff Hardin & Waite

(57) ABSTRACT

The relay has a structure with a coil, yoke and armature as well as contacts, whereby one of the contacts is connected to a terminal element via the yoke and a plug fuse. The yoke has a yoke section that extends laterally at the relay into the proximity of the bottom side. A laterally projecting spring clip is respectively secured both to the yoke section as well as to the appertaining terminal element. The two spring clips are bridged by the plug fuse attached laterally to the relay.

8 Claims, 2 Drawing Sheets

ELECTROMAGNETIC RELAY WITH A FUSE

BACKGROUND OF THE INVENTION

The invention is directed to an electromagnetic relay having a coil, a yoke and an armature, at least one stationary and at least one movable contact actuatable by the armature, whereby a first contact is directly connected to a first terminal element and a second contact is connected to a second terminal element via two conductor sections bridged by a pluggable melt fuse, and whereby the terminal elements emerge toward the outside through a bottom side of the relay.

Such a relay is disclosed, for example, by DE 32 09 915 A1. This discloses a relay, particularly for motor vehicles, whereby additional contact lugs are conducted upward from the actual relay system within the housing and are bridged by a melt fuse arranged at the outside on the housing, and the terminal contacts of the lugs extend through a top-side housing opening into the inside of the housing. Accordingly, the relay therein must have a more or less central opening in the upper side of the housing, as a result whereof protecting the relay in the inside against environmental influences is deteriorated. Since, of course, the normal load circuit terminals are usually conducted to the bottom side and out therefrom in a downward direction, additional terminal lugs to the fuse lying at the upper side are also required. Finally, the fuse attached onto the housing also increases the structural height of the relay.

DE 37 08 723 A1 also discloses a relay having a structured standard for, in particular, motor vehicles, whereby a load circuit terminal is conducted over a yoke and over a terminal element of highly electrically conductive material connected to the yoke.

SUMMARY OF THE INVENTION

A goal of the present invention is to fashion a relay design of the species initially cited such that a standardized relay design having optimally few changes and optimally few auxiliary parts is equipped for the acceptance of a melt fuse. The protective effect of a housing cap should thus be largely retained insofar as possible and the structural height should also not be increased.

In such a relay, this goal is inventively achieved in that the second contact is connected to the yoke, which comprises a yoke section extending perpendicular to the bottom side in the region of an outside of the relay, in that the second terminal element extends through the bottom side in the extension of the yoke section, electrically insulated therefrom, in that both the yoke section as well as the second terminal element each respectively carries a spring clip laterally projecting from the outside, and that the two spring clips aligned with one another at a predetermined distance for accepting the fuse element.

Given the inventive relay, thus, the plug fuse is located in the region of a sidewall of the relay, whereby the spring clips to be connected to the fuse are conducted out of the housing. This preferably occurs in the proximity of the bottom side of the relay, so that the housing cap, with its protective effect, is largely preserved and need only comprise slight clearances in the region close to the bottom side.

The spring clips are respectively preferably connected to the yoke leg or, respectively, to the terminal element via webs, namely at sections via which the load current is already conducted toward the outside given standard structures. Compared to the standard structures, thus, the yoke leg and the second terminal element can remain essentially unmodified, whereby it is merely the usual, direct connection between yoke leg and terminal element that is parted in order to enable the bridging by the plug fuse. The webs serving the purpose of connection can, for example, be fashioned of one piece with the respective yoke leg or, respectively, the terminal element or can also be subsequently connected thereto, for example by welding or soldering. The spring clips, which directly accept the plug blades of the plug fuse, can be fashioned of one piece with the webs or can be subsequently connected thereto by welding, soldering or riveting.

As already mentioned, a housing cap of the relay can largely retain its standard form when it is merely provided with appropriate recesses for said webs. It then has one of its sidewalls engaging between the actual relay and the plug fuse with the spring clamps. However, it is also advantageous to apply an additional pocket to the cap that at least partially surrounds the plug fuse with the terminal posts. It is thereby in turn advantageous when this pocket is open toward the upper side in order to enable the replacement of the plug fuse without removing the relay housing cap.

The invention is explained in greater detail below with reference to exemplary embodiments on the basis of the drawing.

DESCRIPTION OF THE PREFERRED EMBODIMENTS

Figure 1:
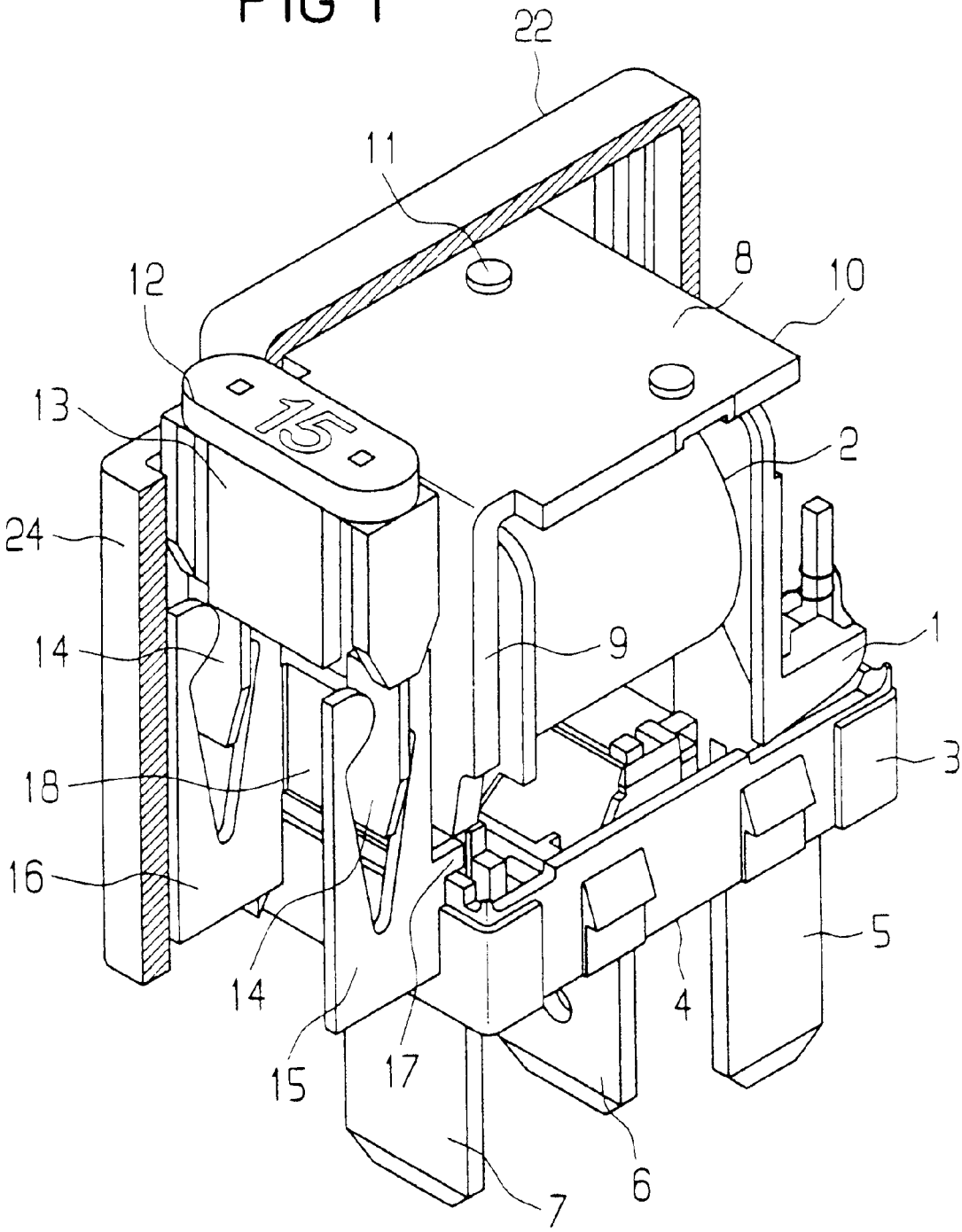
FIG. 1 is a perspective view of an inventively fashioned relay with plug fuse, whereby the housing cap the relay is partially cut away.

The relay shown in FIG. 1 comprises a magnet system with a coil body 1 that carries a winding 2. The coil is seated on a base 3 that defines a bottom side 4 parallel to the coil axis. Terminal elements are conducted toward the outside through the base 3 perpendicular to the bottom side, namely coil terminal elements 5 (only one is visible) as well as load terminal elements 6 and 7, respectively in the form of flat plugs or blades. A L-shaped yoke 8 has a principal leg extending above the coil parallel to the bottom side and has a yoke section 9 extending perpendicular to the coil axis into the proximity of the base 3. The yoke 8 forms a bearing edge 10 for an armature (not shown) that carries a contact spring (likewise not shown) with a movable contact. A fixed contact (not visible) is connected to the terminal element 6 inside the relay.

The contact spring (not shown) is secured to the yoke 8 via rivet knobs 11 and is thus electrically connected thereto. Moreover, the yoke 8 is connected to the terminal element 7, which is anchored in the base 3 and is fashioned as a flat blade or plug, in order to close the load circuit. However, the terminal element 7 that is arranged in an extension of the yoke leg 9 is not directly connected to the latter but is separated or, respectively, electrically insulated therefrom by an air gap. The connection ensues via a plug fuse 12 that has the known structure of motor vehicle fuses. It is essentially composed of an insulating carrier member 13 from which two plug blades 14 project toward the outside. In the inside of the fuse 12, the two plug blades 14 are connected via a conductor section having a small cross-section that melts given an excessively high current load and thereby interrupts the load circuit.

Two fork-shaped spring clips 15 and 16 are arranged in alignment with one another and at an appropriate distance corresponding to the plug blades for the acceptance of the two plug blades 14. The spring clip 15 is connected via a web 17 to the terminal element 7, whereas the spring clip 16 is connected via a web 18 to the yoke leg 9.

Figure 3:
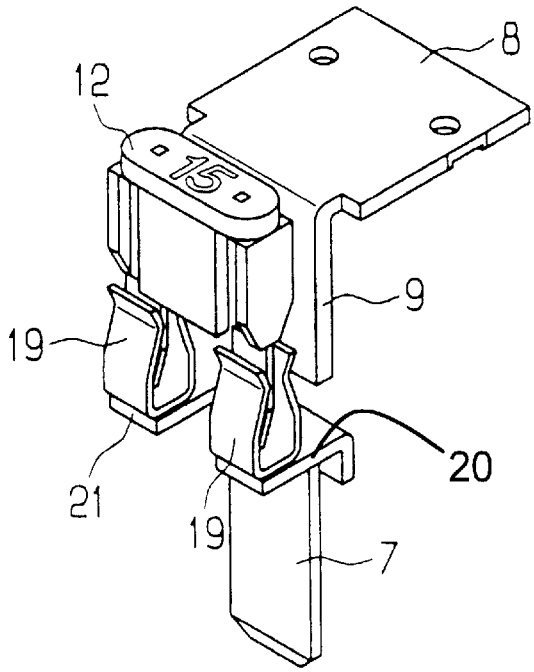
FIG. 3 is a perspective view of a modified embodiment of FIG. 1.

Fundamentally, the spring clips together with their respective webs 17 or, respectively, 18 can be respectively applied of one piece to the part that carries them, as shown for the web 17 in FIG. 1. This is fashioned of one piece with the terminal element 7. The web 18 is welded or soldered onto the yoke leg 9. The spring clips 15 and 16 in the case of FIG. 1 are punched fork-shaped from a flat sheet metal. However, as shown in FIG. 3, modified U-shaped spring clips 19, could also be put in place onto correspondingly horizontally bent-out webs 20 or, respectively, 21 and could be secured by riveting, welding or soldering.

Figure 2:
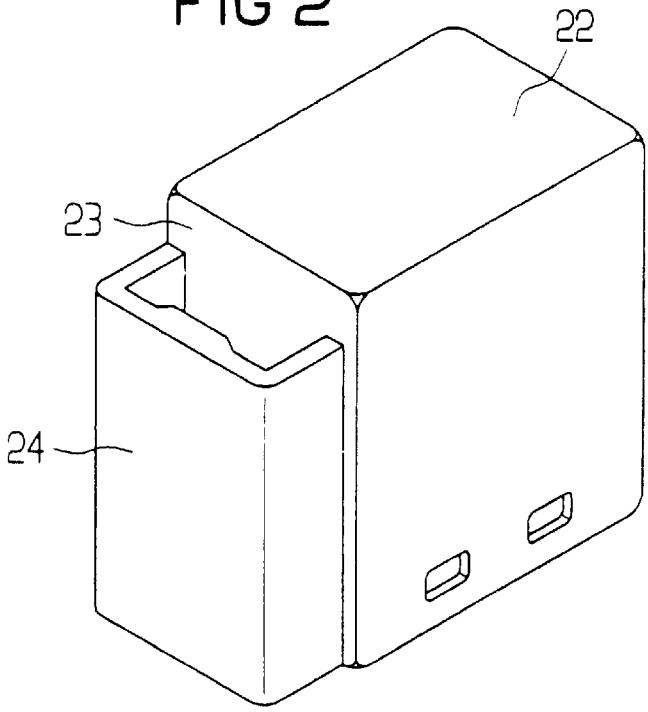
FIG. 2 is a perspective view of the housing cap of the relay at FIG. 1.

The relay has a housing cap 22 that is shown cut away in FIG. 1 and completely in FIG. 2. This housing cap 22 has its sidewall 23 engaging parallel to the yoke leg 9 between the actual relay system and the plug fuse 12. In this way, the housing formed by the base 3 and the housing cap 22 is maintained largely closed, since the housing wall 23 must comprise recesses or openings for the webs 17 and 18 engaging therethrough only in the lower edge region.

Further, a pocket 24 is applied to the housing cap and surrounds the fuse 12 together with the spring clips 15 and 16 and thus protects them. The pocket 24 is opened toward the upper side, so that the fuse 12 can be replaced even without removing the housing cap 22. The fuse can project somewhat from the cap. Otherwise, however, the cap must be designed such that the fuse can be replaced with commercially obtainable pulling aids.

We claim:

1. An electromagnetic relay having a coil, a yoke, a first contact being directly connected to a first terminal element and a second contact being connected to a second terminal element via two conductor sections bridged with a pluggable, meltable fuse and the terminal elements emerging downward through a bottom side of the relay, the improvement comprising the second contact being connected to the yoke, which has a yoke leg extending perpendicular to the bottom side in a region of an end of the coil, the second terminal element extending through the bottom side in an area of the yoke leg and being electrically insulated therefrom, both the yoke leg and the second terminal element carrying a spring clip projecting laterally to an outside of the relay, and the two spring clips being aligned with one another at a predetermined distance for the acceptance of the meltable fuse.

2. A relay according to claim 1, wherein the spring clips are respectively held by a web projecting perpendicularly from the yoke leg and the second terminal element.

3. A relay according to claim 2, wherein the webs are bent out in one piece from the plane of the yoke leg and the second terminal element.

4. A relay according to claim 2, wherein the webs are connected to the yoke leg and the second terminal element by welding or soldering.

5. A relay according to claim 2, wherein the spring clips are connected to the appertaining web by welding, soldering or riveting.

6. A relay according to claim 2, which comprises a housing cap; the webs are arranged in the proximity of a bottom side of the cap, and a sidewall of the housing cap proceeds between the yoke leg and the spring clips with the melt fuse.

7. A relay according to claim 6, wherein the housing cap has a pocket which at least partially surrounds the spring clips and the melt fuse.

8. A relay according to claim 7, wherein the pocket is opened toward an upper side of the relay.

* * * * *